United States Patent [19]

Wada et al.

[11] Patent Number: 4,753,690

[45] Date of Patent: Jun. 28, 1988

[54] METHOD FOR PRODUCING COMPOSITE MATERIAL HAVING AN ALUMINUM ALLOY MATRIX WITH A SILICON CARBIDE REINFORCEMENT

[75] Inventors: Tsuguyasu Wada, Ann Arbor, Mich.; Daniel J. Adenis, Lancaster, Pa.; Thomas B. Cox, Ann Arbor, Mich.

[73] Assignee: Amax Inc., Greenwich, Conn.

[21] Appl. No.: 896,037

[22] Filed: Aug. 13, 1986

[51] Int. Cl.[4] ..... C22D 1/04

[52] U.S. Cl. ..... 148/11.5 A; 148/11.5 Q; 148/415; 148/2; 148/440; 428/614

[58] Field of Search ..... 164/97, 461; 428/608, 428/614; 148/11.5 A, 11.5 Q, 415, 417, 440; 420/542, 541, 544, 545, 532, 533, 534

[56] References Cited

U.S. PATENT DOCUMENTS

| | | | |
|---|---|---|---|
| 3,455,662 | 7/1964 | Alexander et al. | 428/608 |
| 3,918,141 | 11/1975 | Pepper | 428/608 |
| 4,134,759 | 1/1979 | Yajima | 428/608 |
| 4,444,603 | 4/1984 | Yamatsuta | 428/614 |
| 4,450,207 | 5/1984 | Donomoto et al. | 428/614 |
| 4,473,103 | 9/1984 | Kenney et al. | 164/97 |
| 4,565,744 | 1/1986 | Walter et al. | 428/614 |
| 4,601,955 | 7/1986 | Kurahashi et al. | 428/614 |

FOREIGN PATENT DOCUMENTS

| | | | |
|---|---|---|---|
| 13798 | 8/1980 | European Pat. Off. | 420/542 |
| 206154 | 11/1984 | Japan | 164/97 |
| 602306 | 4/1978 | U.S.S.R. | 164/97 |

OTHER PUBLICATIONS

G. G. Levi et al., Chemical Abstracts, 89: 115785q, 1978.

R. Mehrabian, Chemical Abstracts, 94: 6977s, 1980.

*Primary Examiner*—John J. Zimmerman

*Attorney, Agent, or Firm*—Michael A. Ciomek; Eugene J. Kalil

[57] ABSTRACT

Reinforced composite aluminum-matrix articles containing up to 20%, by volume, silicon carbide fibers or particles, are produced by a casting process wherein about 4% to about 7%, by weight, of magnesium is included in the aluminum matrix alloy to facilitate wetting of the reinforcing material and ready dispersal thereof with the matrix alloy while the alloy is completely molten and thereafter hot working the composite at a temperature between the liquidus and solidus temperatures of the aluminum alloy matrix. The matrix is characterized by a microstructure wherein fine precipitates appear in the vicinity of SiC particles or fibers, and by high hardness and strength without further heat treatment.

9 Claims, 1 Drawing Sheet

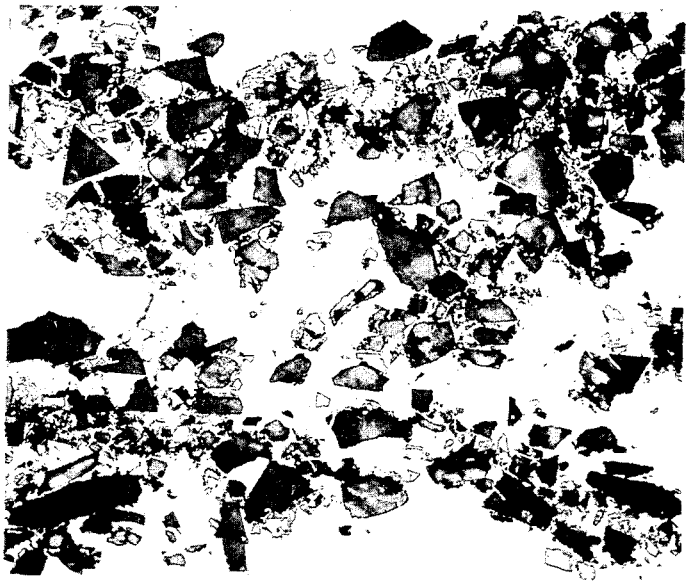

METHOD FOR PRODUCING COMPOSITE MATERIAL HAVING AN ALUMINUM ALLOY MATRIX WITH A SILICON CARBIDE REINFORCEMENT

The present invention deals with the production of composite materials having an aluminum alloy matrix reinforced with discontinuous fibers or particulates made of silicon carbide.

BACKGROUND OF THE INVENTION

It has been recognized in the art that the properties of aluminum matrix alloys could be improved in one or more important respects by dispersing throughout the matrix a dissimilar material having little or no solubility in the metal matrix. For example, graphite dispersed in aluminum improves the wear resistance thereof. Graphite, normally speaking, is insoluble in and immiscible with an aluminum melt and would be rejected from such a melt. U.S. Pat. No. 3,885,959 teaches coating the graphite surfaces with nickel, a metal which is wetted readily by molten aluminum thereby facilitating ready dispersal of the nickel-coated graphite particles in the aluminum melt. U.S. Pat. No. 3,985,557 discloses incorporating materials such as zircon, alumina, zirconia or aluminum silicates in an aluminum melt containing about 2% to about 10% of magnesium. The patent teaches that magnesium is a metal reducing agent for reducing the surfaces of aforementioned oxide fillers to a metal-like coating. Use of silicon carbide as a filler is not disclosed in the patent. In contrast to oxide fillers, magnesium has a lower affinity to carbon than does aluminum, and it is believed to be unexpected that magnesium reduces silicon carbide surfaces to form metallic coatings. Silicon carbide particles and fibers are difficult to wet with molten aluminum.

SUMMARY OF THE INVENTION

In accordance with the invention particulate silicon carbide is introduced into a bath of molten aluminum containing about 4% to about 7% magnesium to promote wetting of the silicon carbide with the molten alloy. The resulting melt is cast into ingot which can be formed by extrusion or other processes; including, in particular, hot pressing at a temperature between the liquidus and solidus temperatures of the matrix whereby the as-extruded or as-press-formed strength of the composite material is high without heat treatment.

DESCRIPTION OF THE DRAWING

The drawing depicts the microstructure, taken at 500 diameters, of a composite material containing silicon carbide and titanium carbide particles dispersed in an aluminum-magnesium alloy matrix.

DETAILED DESCRIPTION OF THE INVENTION

In accordance with the invention, a melt of aluminum-magnesium alloy containing about 4% to about 7% magnesium is established and is heated to a temperature range of about 700° to about 800° C.; i.e., a temperature at least about 40° C. above the liquidus temperature for the alloy. Particulate silicon carbide, preferably having a particle size of about 5 to about 70 microns is then introduced into the bath in amounts of about 7% to about 20%, by volume, by a simple mechanical mixing technique, e.g., stirring. Due to the presence of magnesium in the bath, the silicon carbide particles are readily wetted thereby and are incorporated therein. The resulting molten material is solidified as by casting into an ingot mold, continuous casting, etc. to provide a composite material having particulate silicon carbide distributed discontinuously and substantially homogeneously through a matrix of aluminum-magnesium alloy.

Magnesium in the aluminum alloy causes solid solution strengthening as a major strengthening mechanism and precipitation hardening as a contributing factor in the high magnesium composition ranges. Cold and warm deformation gives significant strengthening due to increased precipitation as well as an increased density of dislocation. In the invented composite, stresses may be present around the reinforcing particles or fibers and give an enhanced hardening to the matrix.

If the magnesium content is too high, the matrix alloy exhibits excessive and unstable precipitation hardening. The maximum content of magnesium is set as 7% for this reason. The magnesium may be added to the melt prior to mixing with the reinforcing material, or alternatively, a master alloy containing magnesium may be prepared in advance and used for melting.

In addition to magnesium, the aluminum alloy melt may contain up to about 7%, e.g., about 0.5% to about 5% silicon; up to about 5%, e.g., about 0.2% to about 4% copper; up to about 4%, e.g., about 0.2% to about 2% zinc; up to about 2% iron, up to about 1% chromium, and other minor elements which are normally contained in commercial aluminum alloys.

The solidified composite may be further processed by extrusion, rolling, press-forming in the solid-liquid two-phase temperature region, or by other forming process or combinations of them.

The silicon carbide reinforcing material may be in the form of particles having an average particle size of about 5 to about 100 microns, e.g., about 7 to about 70 microns; or in the form of fibers having an average diameter of about 2 to about 200 microns, e.g., about 2 to about 140 microns; and a length of about 0.1 to about 3 millimeters. Particularly preferred reinforcing materials are particulates having particle sizes in the range of about 7 to about 70 microns because of their reasonable costs and fairly good performances. Titanium carbide particles may also be added along with silicon carbide in amounts up to about 5%, by volume, as TiC is readily wetted and reduces solidification shrinkage.

Examples will now be given.

EXAMPLE 1

450 grams of alumunim alloy 6061 (nominally 1% Mg) were melted in a graphite crucible in an electric furnace and 21 grams of magnesium were added. Then at about 700° C. (1305° F.), 85 grams of SiC particulates, 400 mesh particle size, were added and mechanically stirred. The SiC was wet with the molten alloy satisfactorily. The crucible was taken out of the furnace and cooled with forced air. A homogeneous ingot was obtained. The ingot nominally contains 4.5 wt. % Mg and 14.3 wt. % or 12.3 vol. % SiC.

EXAMPLE 2

490 grams of aluminum alloy 6061 were melted in a graphite crucible in an electric furnace and 21 grams of magnesium were added. Then at about 700° C. (1305° F.), 85 grams of SiC particulates, 400 mesh particle size, and 20 grams of TiC particulates were added and mechanically stirred. The reinforcing materials were wet with the molten alloy satisfactorily. The crucible was taken out of the furnace and cooled with forced air. The ingot was fairly homogeneous, and nominally contained 4.4 wt. % Mg, 3.2 wt. % TiC, and 13.8 wt. % or 11.9 vol. % SiC. The ingot was extruded at 400° C. (750° F.) at a reduction ratio of 1:9 without problem. The as-extruded composite had a hardness of 93 HV10, as compared to the hardness of the base alloy 6061 in the same condition, 55 HV10.

EXAMPLE 3

485 grams of aluminum alloy 6061 were melted in a graphite crucible in an electric furnace and 35 grams of magnesium were added. Then at about 700° C. (1305° F.), 85 grams of SiC particulates, 400 mesh particle size, and 20 grams of TiC particulates were added and mechanically stirred. The reinforcing materials were wet with the molten alloy satisfactorily. The crucible was taken out of the furnace and cooled with forced air. The ingot was fairly homogeneous, and almost no shrinkage cavity appeared. The nominal composition of the ingot was 6.6 wt. % Mg, 3.2 wt. % TiC, and 13.6 wt. % or 11.7 vol. % SiC. The ingot was extruded at 400° C. (750° F.) at a reduction ratio of 1:9 without problem. The as-extruded composite had a hardness of 102 HV10. After a T6 heat treatment, the extruded material showed a hardness of 106 HV10, the increase in hardness by the T6 treatment being only four points. A portion of the extruded material was hot pressed at 630° C. (1165° F.), which is in the range between liquidus and solidus temperatures of the matrix alloy. The product of the two-phase forming showed a hardness of 150 HV10, an almost 50% increase from the as-extruded hardness, and the microstructure thereof, taken at 500 diameters, is shown in the drawing. A similarly treated aluminum-magnesium alloy without reinforcement showed a hardness of 90 HV10. In comparison, an alloy 6061-matrix composite, containing 15.4 vol. % SiC and 0.27% Li, without addition of Mg, showed a Vickers hardness of 82 HV10 after a similar two-phase forming. The same material showed a hardness of 117 HV10 after a T6 heat treatment.

The product of two-phase forming at a temperature between the liquidus and solidus temperatures for the matrix alloy has a characteristic microstructure wherein fine precipitates appear in the vicinity of SiC particles, as shown in the FIGURE. Some of the fine particles of a different color could be TiC. The matrix is relatively free from precipitates.

It is to be appreciated that, in addition to increasing wettability, magnesium has at least two other major effects which are beneficial for hot forming: First, magnesium expands the liquid-solid two-phase temperature range and makes two-phase forming easier; second, magnesium provides hardening in the matrix alloy through the mechanism as will be explained below, and the as-extruded or the as-press-formed strength of the composite is quite high. Because of the latter effect, the composite does not require heat treatment after extrusion or other hot forming operations. Most aluminum-matrix composites require heat treatment after extrusion because extrusion of the aluminum-matrix composites usually is carried out with a relatively slow ram speed, and quenching immediately after the extrusion may not always be practically feasible.

The effect of magnesium on the hardening of the invented composite in the as-extruded or the as-press-formed strength is evidently through the hardening in the matrix. Magnesium results in solid solution strengthening as a major strengthening mechanism, while precipitation hardening is also contributing in the high magnesium composition range. It is reasonably understood that stresses are present around the reinforcing particles due to the difference in the thermal expansion coefficient between the matrix and the reinforcing particles, and the stresses enhance the strengthening in these areas in the matrix. Thus, the addition of the non-metallic reinforcing materials and magnesium appear to have a synergistic effect on the hardening of the composites.

Although the present invention has been described in conjunction with preferred embodiments, it is to be understood that modifications and variations may be resorted to without departing from the sirit and scope of the invention, as those skilled in the art will readily understand. Such modifications and variations are considered to be within the purview and scope of the invention and appended claims.

We claim:

1. The method for producing a composite material having a matrix of aluminum-magnesium alloy and at least about 7% up to about 20%, by volume of a discontinuous phase from the group consisting of silicon carbide particles and silicon carbide fibers, and up to about 5%, by volume, of titanium carbide particles which comprises preparing a bath of aluminum alloy containing about 4% to about 7% magnesium, mixing said discontinuous phase material with said bath at a temperature above the liquidus temperature thereof for a time sufficient to provide substantially complete dispersion of said material throughout said bath and solidifying said bath while maintaining said dispersion to provide a solid composite having silicon carbide reinforcement throughout an aluminum alloy matrix, and thereafter hot working said composite at a temperature between the liquidus and solidus temperatures of said aluminum alloy matrix, said matrix being characterized by a microstructure wherein fine precipitates appear in the vicinity of SiC particles or fibers, and by high hardness and strength without further heat treatment.

2. The method of claim 1 wherein the final step of said hot working is an extrusion or a hot-pressing step.

3. The method in accordance with claim 1 wherein said aluminum-magnesium alloy also contains up to about 4% copper, up to about 7% silicon, up to about 2% zinc, up to about 2% iron, and up to about 1% chromium.

4. The method in accordance with claim 1 wherein said particles have an average size of about 5 to about 100 microns.

5. The method in accordance with claim 1 wherein said fibers have an average diameter of about 2 to about 200 microns and an average length of about 0.1 to about 3 millimeters.

6. The method in accordance with claim 1 wherein said mixing is accomplished by stirring.

7. The method in accordance with claim 1 wherein said bath is cast in a static mold.

8. The method in accordance with claim 1 wherein said bath is solidified by continuous casting.

9. A composite material having a matrix of aluminum alloy containing about 4% to about 7% magnesium and having about 7% to about 20% by volume, of reinforcing material from the group consisting of silicon carbide particles and silicon carbide fibers discontinuously and substantially uniformly distributed therethrough, said composite material being in the condition resulting from a final hot working operation at a temperature between the liquidus and solidus temperatures for the matrix alloy and being characterized by a microstructure wherein fine precipitates appear in the vicinity of SiC particles or fibers, and by high hardness and strength without further heat treatment.

* * * * *